United States Patent [19]

Schick et al.

[11] Patent Number: 4,775,078

[45] Date of Patent: Oct. 4, 1988

[54] SPRAY BOTTLE FOR A CLEANING LIQUID

[75] Inventors: Juergen Schick, Hemsbach; Bernd Kaschewski, Erpolzheim; Kurt Ehrenfried, Ludwigshafen, all of Fed. Rep. of Germany

[73] Assignee: Joh. A. Benckiser GmbH, Ludwigshafen, Fed. Rep. of Germany

[21] Appl. No.: 914,663

[22] Filed: Oct. 2, 1986

[30] Foreign Application Priority Data

Oct. 4, 1985 [DE] Fed. Rep. of Germany ..... 3535488

[51] Int. Cl.[4] ..... B65D 37/00

[52] U.S. Cl. ..... 222/212; 222/562; 222/570; 222/575

[58] Field of Search ..... 222/153, 575, 206, 212, 222/215, 562, 570, 567, 566, 490, 491, 212, 545, 546, 544, 542; 215/100 R, 204; 206/527

[56] References Cited

U.S. PATENT DOCUMENTS

| | | | |
|---|---|---|---|
| 2,288,101 | 6/1942 | Mayer | 222/566 |
| 2,734,665 | 2/1956 | Flamm | 222/212 |
| 2,947,453 | 8/1960 | Parrish, Jr. et al. | 222/562 |
| 3,124,281 | 3/1964 | Stall | 222/546 |
| 3,285,256 | 11/1966 | Despard | 222/575 |
| 3,756,460 | 9/1973 | Hill | 222/212 |
| 3,760,987 | 9/1973 | Meierhoefer | 222/562 |
| 3,870,200 | 3/1975 | Spatz | 222/206 |
| 4,509,661 | 4/1985 | Sugizaki et al. | 222/190 |

FOREIGN PATENT DOCUMENTS

| | | | |
|---|---|---|---|
| 228188 | 5/1958 | Australia | 222/570 |
| 3121591 | 3/1982 | Fed. Rep. of Germany . | |

*Primary Examiner*—Michael S. Huppert
*Assistant Examiner*—Kenneth Noland
*Attorney, Agent, or Firm*—Foley & Lardner, Schwartz, Jeffery, Schwaab, Mack, Blumenthal & Evans

[57] ABSTRACT

The spray bottle has a bottle body, an elbow mounted thereon in an impact connection, and a nozzle mouthpiece supported by the elbow and directed obliquely upwards. The spraying direction of the nozzle mouthpiece encloses an angle between 50° and 75°, preferably approximately 73°, with the longitudinal median axis of the bottle body. The nozzle mouthpiece is covered by a closure cap. The nozzle mouthpiece and closure cap can be locked by catching on a nipple supported by the elbow. A childproof connection may be provided for the closure cap.

13 Claims, 6 Drawing Sheets

SPRAY BOTTLE FOR A CLEANING LIQUID

BACKGROUND OF THE INVENTION

The invention relates to a spray bottle for a cleaning liquid, particularly for cleaning toilet bowls, with a manually compressible bottle body and a spray nozzle located in the upper terminal region of the latter and directed obliquely upwards.

A conventional spray bottle is known from German Offenlegungsschrift No. 3,121,591. This known bottle has a spray nozzle directed steeply upwards, the center axis of which, pointing in the spray direction, encloses an angle of approximately 40° with the longitudinal direction of the bottle body. This form of construction is not very favorable when it is attempted, with the bottle held substantially upright, to spray the underside of the indrawn upper rim of a toilet bowl. It is necessary for this purpose to reach deeply into the toilet with the hand holding the spray bottle, which is unpleasant and hygienically objectionable. It is not immediately possible, according to the conventional plastics production technique, such as tube drawing and injection molding, to make the angle of incidence of the spray nozzle less steep due to inherent mold release limitations.

A dispenser for expanded brine is known from U.S. Pat. No. 4,509,661, in which an elbow with a nozzle is screwed onto a compressible bottle body. The spray direction encloses an angle of approximately 60° with the longitudinal direction of the bottle body. The nozzle is inserted to fit into an orifice of the elbow. This dispenser has a field of application outside the present context. The assembly is comparatively complicated while the fluid-tightness, which is required particularly for corrosive cleaning liquids, does not appear to be assured.

SUMMARY OF THE INVENTION

It is therefore an object of the present invention to disclose a spray bottle which permits a well-dosed discharge of liquid at a technically favorable angle for operation without a surging or dripping of liquid.

It is also an object of the present invention to provide a spray bottle that can be produced by the customary plastics production technique and have good mold release facility.

It is a further object of the present invention to provide a spray bottle that can be conveniently assembled from components while maintaining good sealing qualities.

Another object of the present invention is to provide a spray bottle that can be operated such that the user does not come into contact with residues of corrosive cleaning liquid.

It is still another object of the invention to provide a spray bottle that can be held substantially upright when used to spray the underside of the indrawn upper rim of a toilet bowl.

Yet another object of the invention is to provide a spray bottle that can be used for cleaning toilet bowls in a pleasant and hygienical manner.

In accordance with one aspect of the present invention, these objects are achieved by a spray bottle for a cleaning liquid, particularly for cleaning toilet bowls, which includes:

(a) a manually compressible bottle body;

(b) an elbow releasably attached to an open end of the body, the elbow having a nipple;

(c) an impact closure means for attaching the elbow to the body;

(d) a spray nozzle located in the upper terminal region of the body which includes a nozzle mouthpiece and a closure cap, the nozzle releasably attached to the elbow nipple; and (e) a means for attaching the nozzle to the elbow nipple, such that a center axis of the nozzle which points in the spraying direction encloses an angle between about 50° and 75° relative to the longitudinal direction of the bottle body.

These objects are further achieved by a spray bottle having a nozzle which is supported by an elbow which can be fitted and sealed on the bottle body by an impact closure and supports a nipple on which a nozzle mouthpiece and a closure cap are lockable by catching. The center axis of the nozzle, which points in the spraying direction, encloses an angle between 50° and 75°, preferably approximately 73°, with the longitudinal direction of the bottle body.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is explained more fully below in exemplary embodiments illustrated in the drawing, wherein.

DETAILED DESCRIPTION OF PREFERRED EMBODIMENTS

Figure 1:
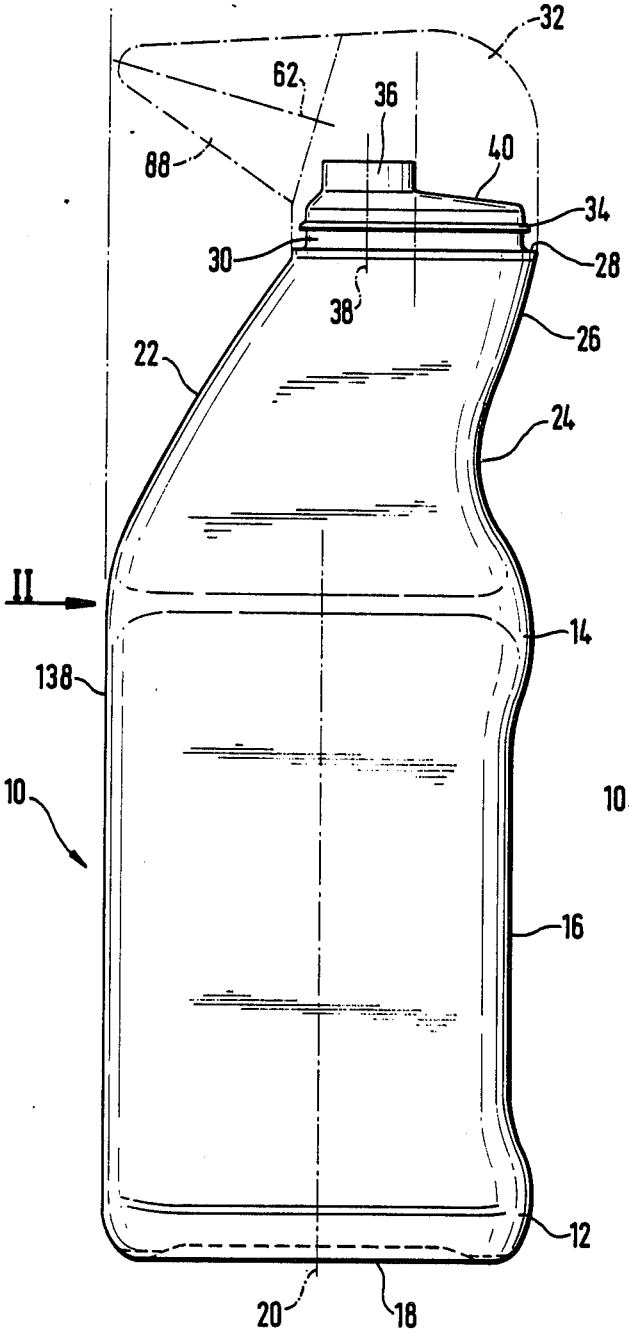
FIG. 1 shows a side view of a first form of construction of a spray bottle, in which a bottle body is illustrated by solid lines, and the outer contour of an elbow and of a closure cap by dash lines.

The bottle according to the present invention, when in the upright position, sprays more strongly to the side than other bottles known in the prior art. This sidewardly directed spray produces substantial advantages in manipulation. Particularly, it is not necessary to go so deeply with the bottle into a toilet bowl when it is required to spray the upper rim of the latter. The attachment of the spray nozzle to an elbow separate from the bottle body has the advantage that the bottle body can be filled in an upright position, as is customary in bottling plants. The elbow is simply pushed on in a sealing manner after filling. The bottle body and elbow are produced from plastics, and no mold release problems occur within the range of angles stated.

In a preferred impact closure for the elbow, the latter has two rows, staggered in the plug-in direction, of studs respectively arranged at intervals, which catch on two correspondingly staggered webs of the bottle body. This double-row catching design ensures a substantial retaining force. The individual mutually distanced studs can be deformed more readily when the elbow is pushed on, than a continuous all-round retaining lip for example, so that the assembly of the spray bottle can be effected conveniently with the exertion of a comparatively small amount of force. By virtue of the catching design on two consecutive webs in the plug-in direction, the pushing on and pulling off of the elbow occurs in two stages. In the case of an attempt to break open the spray bottle, at first both rows of studs come out of engagement with the associated webs, however a lower row of studs on the elbow catches once more behind an upper web of the bottle body, thus creating additional security and serving as a warning function.

The connection between elbow and bottle body may exhibit doubly secure fluid-tightness. For this purpose the elbow may have a pipe section which comes into sealed plug-in connection with a neck of the bottle body. Thus two mutually enclosing sealing zones are obtained with correspondingly increased fluid-tightness. This is desirable particularly when dealing with corrosive cleaning liquids.

A guide device may be provided which aligns and guides the elbow when placed on the bottle body. In a preferred form of construction a guide bar, which is molded integrally on the elbow, engages positively into a groove of the bottle body. The elbow when pushed on is thus conveniently centered, and is stabilized in the case of removal from the bottle body. In a preferred form of construction the elbow has an end face inclined obliquely relative to the longitudinal axis of the bottle body when in the fitted state. The nipple, on which the nozzle mouthpiece and a closure cap may be anchored, projects out in a perpendicular direction from the elbow end face. This form of construction facilitates the aiming of the spray bottle since the spraying direction is obviously clear at the oblique end face.

An end plate which exhibits a plurality of orifices, particularly two eccentrically arranged orifices, may be provided at the base of the nipple, preferably at the height of the end face. This plurality of orifices serves to prevent surging when discharging liquid from the spray bottle. A good return of unsprayed liquid is also obtained into the interior of the spray bottle, in which a negative pressure which conveys the liquid backwards occurs after spraying.

The tip of the nozzle mouthpiece may have an outward-flared trumpet-shaped configuration. This serves to prevent dripping. A sharp separating edge is provided where the liquid exits the spray bottle. This sharp edge prevents the liquid from dripping and soiling the bottle. Therefore, the user does not come into contact with residues of corrosive cleaning liquid.

The closure cap of the spray bottle according to the invention may be locked on an all-round web of the nipple in a childproof snap connection. Children are therefore unable to pull off the closure cap, so that they cannot tamper with a still unopened spray bottle. Childproofness is recommended particularly for spray bottles for cleaning toilets, which customarily contain highly corrosive cleaning liquids and therefore constitute an increased source of danger for children.

The web which serves to anchor the closure cap may be substantially annular and be flattened on a part of the web circumference, preferably along two parallel secants. The flattened parts in this case may be placed staggered at an angle preferably of approximately 90° relative to two wedges of the childproof snap connection. The wedges may be constructed on the end face of the bottle body. The flattened parts facilitate the fitting and removal of the closure cap. The position of the flattened parts relative to the wedges is chosen such that when the childproof closure is actuated the cap can easily be bent over the retaining web.

Figure 2:
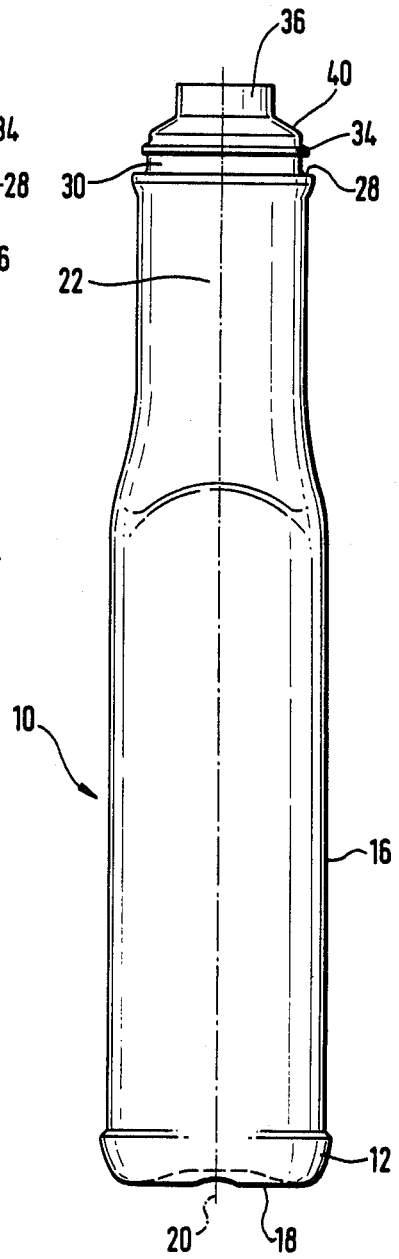
FIG. 2 shows a side view of the bottle body viewed in the direction II from FIG. 1.

FIGS. 1 and 2 show the bottle body 10 of a spray bottle, which is approximately twice as wide as it is deep. The bottle body can be gripped comfortably with one hand. The bottle body consists of a resilient plastic material and can be compressed manually in order to build up a positive pressure in its interior. The bottle body exhibits two beads 12, 14 staggered in the longitudinal direction, which delimit a handle region 16. The lower bead 12 is located near the base 18 of the bottle body, which is drawn slightly inwards, and the upper bead 14 is provided approximately at half the height of the bottle body 10. Above the handle region the bottle body 10 tapers both in width and also in depth (FIG. 1 and FIG. 2). In a plan view of the wide side of the bottle body 10, a swung front flank 22 oriented obliquely relative to the longitudinal median axis 20 of the bottle body 10 may be seen in the tapered region. A necklike constriction 24 on the back of the bottle body 10 merges into a rear flank 26 and is set somewhat less obliquely relative to the longitudinal median axis 20. The flanks 22, 26 terminate in a step 28 which is oriented parallel to the base 18 and marks the transition to an integrally molded projection 30, on which an elbow, only indicated diagrammatically in FIG. 1, can be locked in an impact connection. The projection 30 is approximately one and a half times as wide as it is deep. The projection carries on its external envelope an all-round outwardly projecting web 34, which exhibits an oblique flank towards the top and is recessed radially on its underside. The elbow 32 can therefore be snapped from above onto the web 34.

A pipe section 36 is molded integrally on the upper side of the projection 30. The pipe section axis 38 extends parallel to the longitudinal median axis 20 of the bottle body 10. In a plan view of the narrow side (FIG. 2) the pipe section 36 is located in the center of the projection 30, and molded to the tapered end of the inside diameter of the projection. Viewed from the wide side (FIG. 1), the pipe section 36 is located eccentrically relative to the projection 30, namely on the side which faces the longitudinal median axis 20 of the bottle body 10; however, the axis 38 of the pipe section 36 is staggered to the side relative to the longitudinal median axis 20. The foot of the pipe section 36 is connected by inclined base surfaces 40 to the rim of the projection 30, so that the bottle body 10 is closed towards the top except for the orifice of the pipe section 36.

Figure 3:
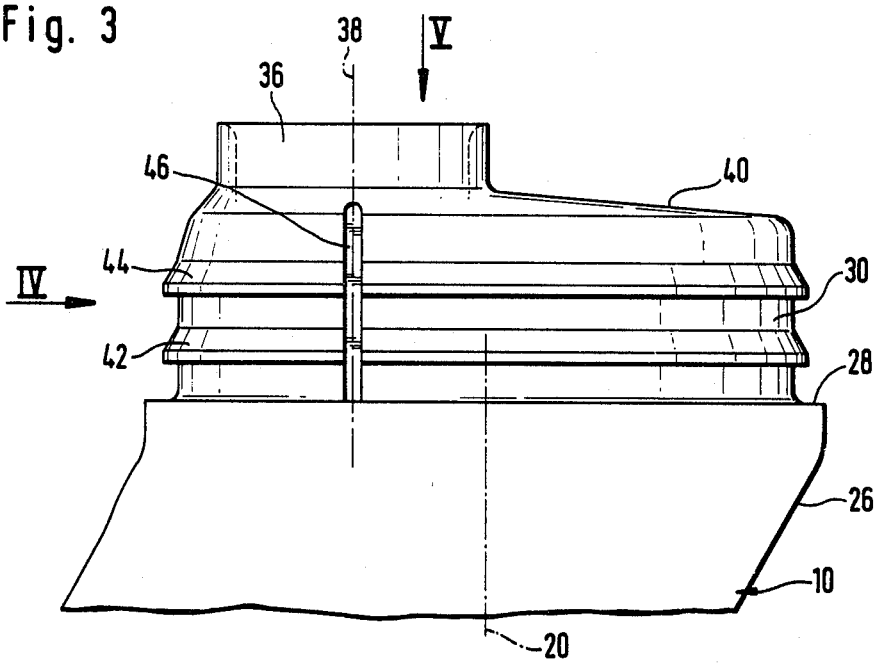
FIG. 3 shows a side view of the upper part of the bottle body of a second form of construction of the spray bottle.
Figure 4:
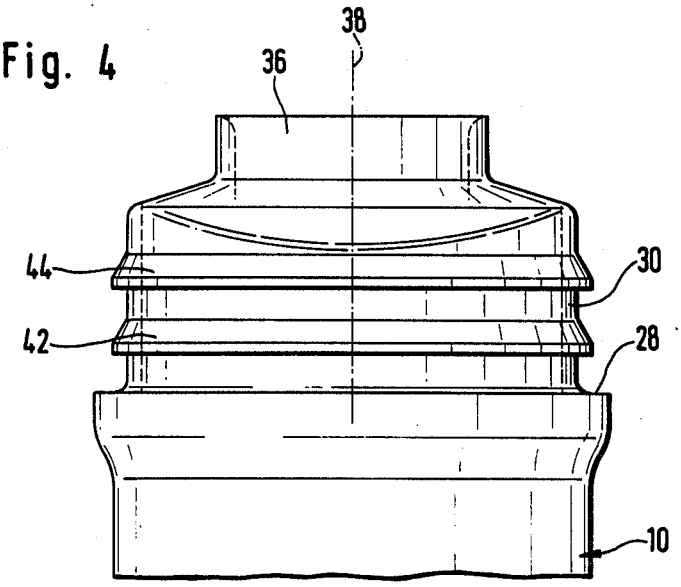
FIG. 4 shows a side view of the bottle body viewed in the direction IV from FIG. 3.
Figure 5:
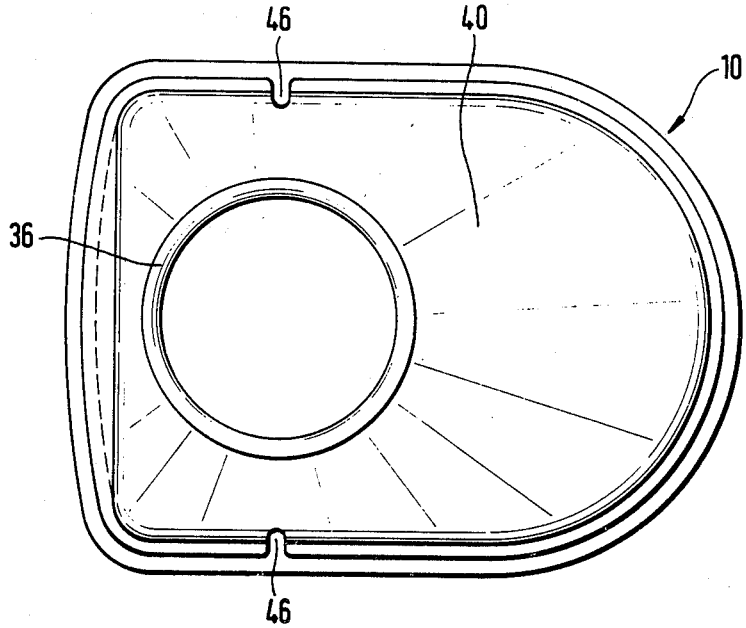
FIG. 5 shows a top plan view of the bottle body in direction V from FIG. 3.

FIGS. 3 to 5 show an alternate embodiment of construction of the bottle body 10. Here, instead of a single web 34, two webs 42, 44 are molded on the projection 30, being located mutually parallel at an interval and consecutively in the axial direction. As explained further below, a double catch effect is obtained when the elbow 32 is pushed on the bottle body. The external envelope of the projection 30 is further provided with two grooves 46 extending in the axial direction, which are molded with mirror image symmetry relative to the longitudinal median plane of the bottle body 10 and are mutually diametrically opposite at the height of the pipe section 36. The grooves 46 serve to guide the elbow 32 when the elbow is pushed on the bottle body.

Figure 6:
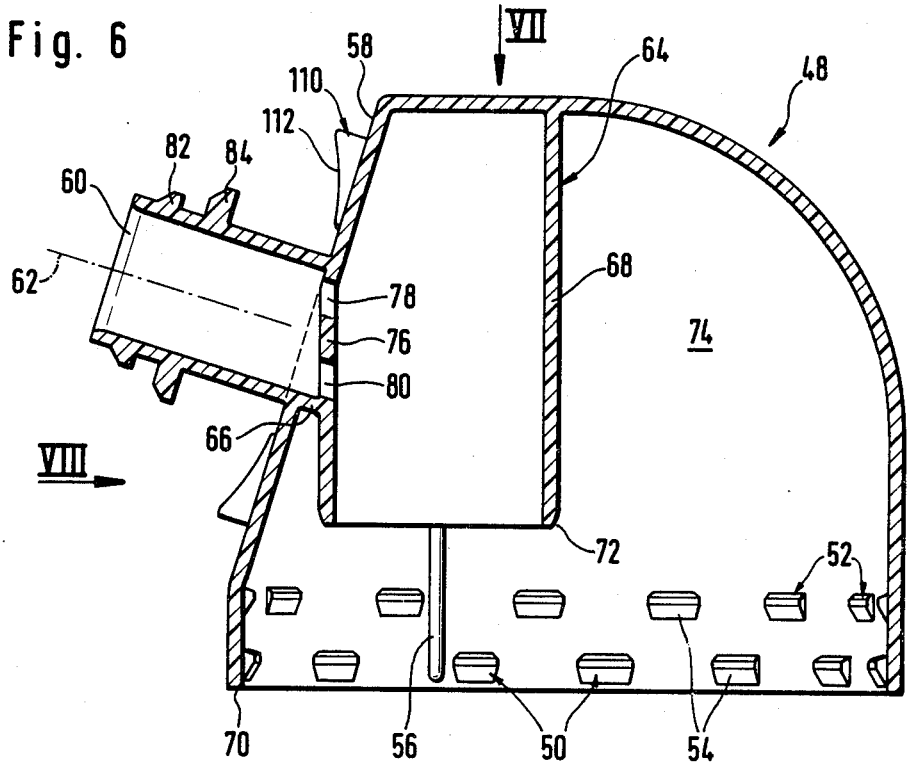
FIG. 6 shows a longitudinal section view through an elbow.
Figure 7:
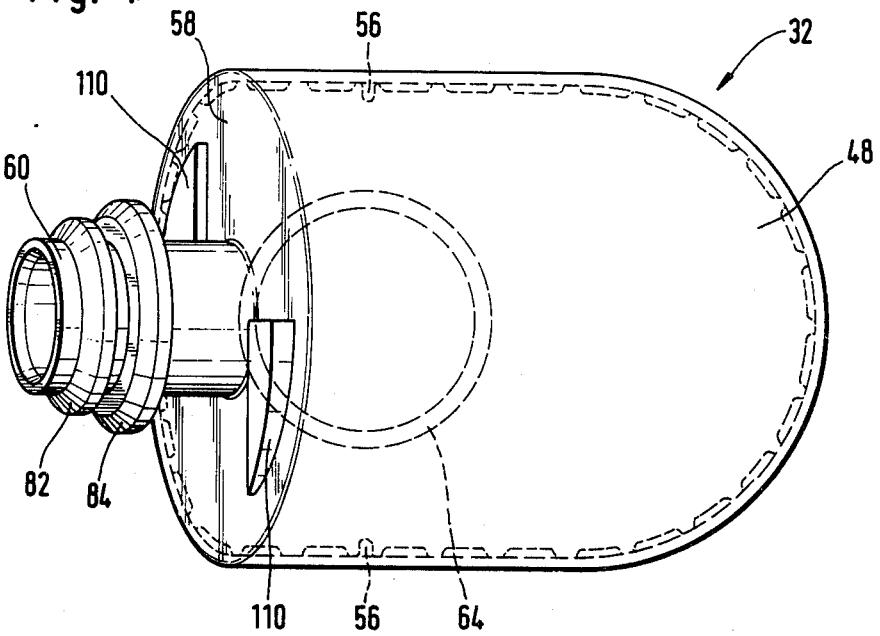
FIG. 7 shows a top plan view of the elbow viewed in the direction VII from FIG. 6.
Figure 8:
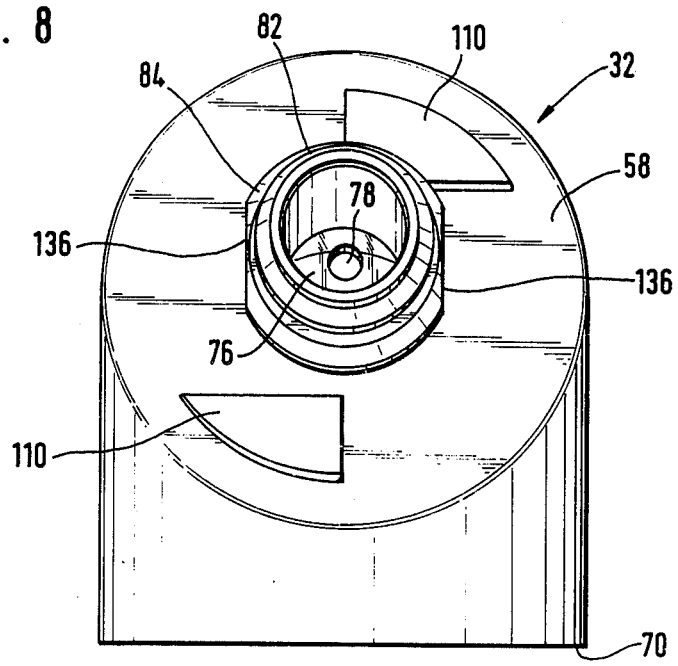
FIG. 8 shows a view of the end face of the elbow in the direction VIII from FIG. 6.

FIGS. 6 to 8 show in further detail the elbow 32 to be fitted to the bottle body 10. The elbow 32 has a downwardly open housing 48 which fits onto the projection 30. Catch studs 50, 52, which are molded on the inner envelope of the housing 48, engage under the webs 42, 44 on the external envelope of the projection 30 and thereby retain the elbow 32 firmly on the projection 30.

The studs 50 can be pressed over the webs 42, 44 by oblique flanks 54. Two rows of studs 50, 52 may be seen, which are consecutive in the push-on direction and exhibit the same interval as the webs 42, 44. In each of the two rows, the studs 50, 52 are mutually distanced and set staggered from row to row; therefore, a stud 50 in the lower row placed near the orifice fits into a gap in the upper inner row of studs 52 and vice versa. In the pushed-on position, the studs 50 of the lower row engage with the lower web 42 and studs 52 of the upper row engage with the upper web 44 placed farther towards the free end of the bottle body 10. The double catch effect ensures a substantial retaining force. On the other hand, the relatively small mutually distanced studs 50, 52 can be deformed easily when the elbow 32 is pushed on, so that the exertion of force required for assembly is kept within limits. The elbow 32 engages on the projection 30 in stages. This is particularly advantageous if an unauthorized attempt is made to release the elbow 32. After the actual assembly position has been broken, the lower row of studs 50 engages once more on the upper outer web 44 of the projection 30, and the exertion of force is necessary again in order to finally remove the elbow 32. The gradual catching effect therefore ensures additional security, and it has a warning function for the user. However, this form of construction is simply one embodiment of the invention; in an alternate embodiment, as shown in FIG. 2, the spray bottle according to the invention may also be provided with a simple impact closure for the elbow 32. Two guide bars 56, which fit into the grooves 46 of the projection 30, are molded on the internal envelope of the elbow 32. The bars 56 engage into the grooves 46 when the elbow 32 is pushed on. The elbow 32 is thereby centered, and, in the case of removal from the bottle body 10, stabilized.

The upper side of the housing 48 is curved in the rear housing region similar to a 90° pipe elbow. On the other hand, the housing 48 presents a plane end face 58 with a substantially circular plan at its front side, which is depicted on the left side in FIG. 6. A nipple 60 is molded integrally on the housing 48. The nipple is located centrally on the end face 58 and extends in a perpendicular direction to the end face 58. The nipple 60 forms the outlet of the spray bottle, and its center axis 62 points in the spraying direction. In the interior of the housing 48 the nipple 60 is immediately adjoined by a downward-pointing pipe stub 64 which is molded integrally on the housing 48. The wall 66 of the nipple 60 is continued on its underside into the housing 48, in order to create a transition to the pipe stub 64. The end face 58 also partly delimits the space enclosed by the pipe stub 64. The rear wall 68 of the pipe stub 64 is drawn up to the upper side of the housing 48. For an orientation of the elbow 32 which corresponds to that in the fitted state of the bottle body 10, the axis of the pipe stub 64 points in the longitudinal direction 20 of the bottle body 10. The pipe stub 64 terminates at an interval from the lower edge 70 of the housing 42. This pipe stub end is provided with a conical bevel 72. In the fitted state of the elbow 32, the pipe stub 64 engages fluid-tightly into the pipe section 36 on the neck of the bottle body 10. A connection is thus established, through which the angled nipple 60 communicates with the interior of the bottle body 10. In principle, the interior space 74 of the housing 42 which is not occupied by the pipe stub 64 does not contain liquid. However, it serves advantageously as a catching tank in the case of a leak in the plug-in connection between pipe section 36 and pipe stub 64. The impact connection of the elbow 42 on the projection 30 is preferably made sealed, so that doubly secure fluid-tightness is formed with two mutually enclosing sealing zones.

The nipple 60 has at its face an end plate 76, which forms a prolongation of the wall of the pipe stub 64 and extends to the height of the end face 58 of the elbow 32. The end plate 76 has two circular orifices 78, 80, which are arranged superposed in the longitudinal median plane of the elbow 32. The rim of the lower orifice 80 extents to the inner envelope of the nipple 60 and forms a fluid tight seal. The passage cross-section at the base of the nipple 60 is reduced by the arrangement of end plate 76 and orifices 78, 80, which serve to prevent surges during the discharge of liquid. The position of the lower orifice 80 furthermore ensures that, after the completion of a spraying operation, liquid can run back unobstructed through the nipple 60 into the interior of the bottle body 10. A transport effect occurs as a result of the negative pressure prevailing therein and also as a result of gravity.

Two all-round catch webs 82, 84 of different diameter projecting radially outwards are placed axially staggered on the nipple 60. The catch web 82 near the orifice has a smaller diameter and serves to snap open a nozzle mouthpiece 86 illustrated in FIG. 9. The second catch web 84 located farther from the orifice of the nipple 60 has a larger diameter and serves to fasten a closure cap 88 shown in FIGS. 10 to 13. Viewed from the orifice of the nipple 60, both catch webs 82, 84 have a conically rising flank, and beyond a short cylindrical transition section they are recessed radially to the external dimension of the nipple 60.

Figure 9:
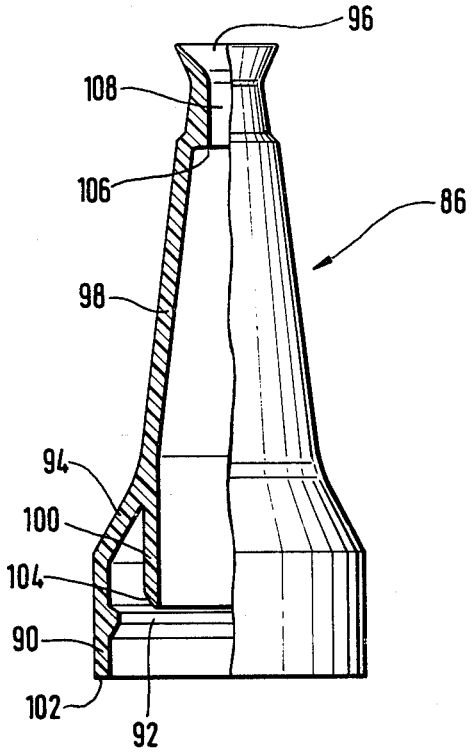
FIG. 9 shows a half longitudinal section view of a nozzle mouthpiece of the spray bottle.

The nozzle mouthpiece 86 shown in FIG. 9 has a substantially circular cylindrical anchorage section 90 which engages radially externally over the nipple 60. An all-round rib 92 which is molded on the inner ring of the anchorage section 90 has a flank tapering conically in the plug-in direction and engages behind the smaller-diameter catch web 82 near the orifice in the assembled state. The anchorage section 90 merges via a conical intermediate piece 94 into the wall 98 of the mouthpiece 86, which tapers conically towards a discharge orifice 96. A pipe stub 100, which terminates at a distance from the rim 102 of the anchorage section 90, is molded on the wall 98 coaxially inside the anchorage section 90. The end of the pipe stub 100 is bevelled 104. In the snapped-on position of the nozzle mouthpiece 86, the pipe stub 100 engages with the nipple 60, while the anchorage section 90 comes in contact with the external envelope of the nipple 60. It is therefore also possible to provide a connection with doubly secure fluid-tightness at this position.

The nozzle mouthpiece 86 exhibits a step-shaped cross-sectional constriction 106 in the region of its discharge orifice 96. Downstream of the latter, a substantially circular cylindrical orifice duct 108 may be seen, which widens in the form of a trumpet on the exit side. This form of orifice produces a definite separating edge, at which the spray jet is cut off, and dripping is effectively prevented. After completion of the spraying operation, liquid remaining in the mouthpiece 86 is sucked back into the nipple 60, and from there travels predominantly through the lower end plate orifice 80 into the bottle body 10.

A childproof device is provided for the closure cap 88. This device comprises wedges 110 molded integrally on the elbow 32, which are present on the end face 58. The wedges 110 have a circular segment-shaped base surface and are arranged in a rotationally symmetrical arrangement relative to the center axis 62 of the nipple 60, staggered at an angle of 180°, so that they are positioned on both sides of the longitudinal median plane of the elbow 32. The wedges have a curved ramp surface 112, which, starting from the end face 58, rises both in the circumferential direction and also radially from the inside outwards.

The closure cap 88 of the spray bottle which is illustrated in FIGS. 10 to 13 has a conical shape with a rounded apex. In the interior of the latter a cylindrical pipe section 116 is molded on the cone envelope 20 in coaxial arrangement, starting approximately at half the height of the closure cap 88 and terminating at a short distance from the cone base 118. The pipe section 116 carries on its interior envelope an all-round rib 120 which is tapered conically in the plug-in direction and adapted to engage behind the larger-diameter catch web 84 on the nipple 60. The closure cap 88 can thus be snapped onto the spray bottle, engaging over and covering the nipple 60 with the nozzle mouthpiece 86 located firmly thereon.

Figure 10:
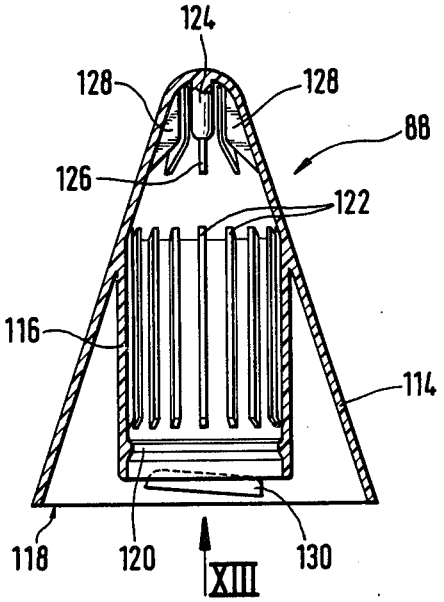
FIG. 10 shows a longitudinal section view of a closure cap with a partly cut away inner pipe section.
Figure 11:
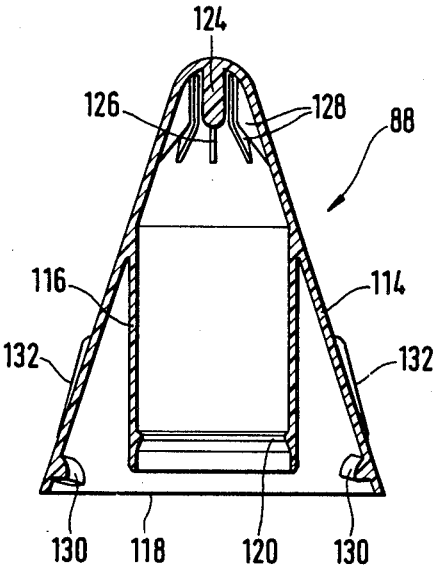
FIG. 11 shows a further longitudinal section view of the closure cap with the plane of section staggered at 90° compared to FIG. 10.
Figure 12:
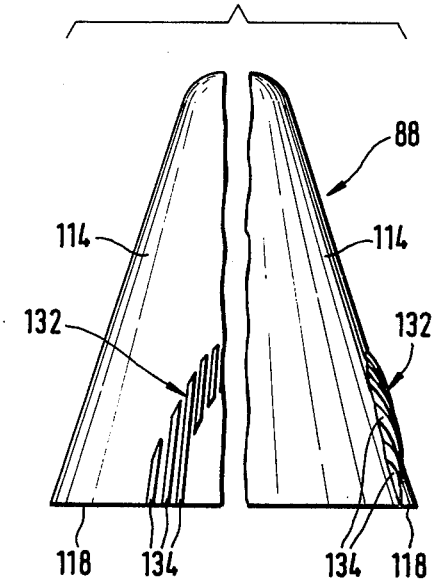
FIG. 12 shows two half views of the closure cap in positions mutually staggered at 90°.
Figure 13:
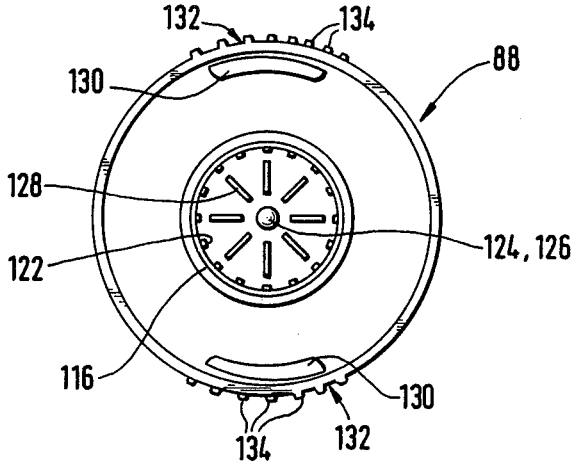
FIG. 13 shows a view into the interior of the closure cap in the direction XIII from FIG. 10.

FIGS. 10 and 13 show, on the inner envelope of the pipe section 116, a profile with a plurality of webs 122 distributed about the circumference and extending in the axial direction. These webs serve to guide the closure cap 88 on the external envelope of the nozzle mouthpiece 86.

A central axial spigot with a dome-shaped rounded hollow element 124 and with a smaller-diameter pin 126 attached axially to the latter, is present at the tip inside the closure cap 88. In the fitted position of the closure cap 88, this spigot projects into the discharge orifice 96 of the nozzle mouthpiece 86, so that the latter is closed. Surrounding the spigot, a plurality of resilient lamellae 128, which are distributed about the spigot circumference, contact the tip of the nozzle mouthpiece 86 and provide additional securing and fastening.

As part of the childproof device, two projections 130, which are mutually diametrically opposite and rise in the circumferential direction, are molded on the inner envelope of the closure cap 88 near the cone base 118. Handle surfaces 132 are present on the external envelope of the closure cap 88 at the height of the projections 130. These surfaces consist each of a plurality of outwardly projecting webs 134 extending in the axial direction. The closure cap 88 can be gripped and compressed by the handle surfaces 132. When the closure cap 88 is fitted its cone base 118 is in contact with the end face 58 of the elbow 32. The projections 130 then project radially outside the wedges 110, so that the closure cap 88 can be rotated freely on the nipple 60. The catch position of the closure cap 88 cannot be released by pulling it off in the axial direction, because too much force is necessary for ths purpose. In order to release the closure cap 88 correctly, the cap must be simultaneously rotated and compressed in the region of the handle surfaces 132, so that the projections 130 come into contact with the wedges 110. In the case of this combined movement the closure cap 88 is raised, bent and released from the nipple 60 by the cooperating oblique ramp surfaces.

As may be seen particularly from FIG. 8, the larger-diameter catch web 84, which retains the closure cap 88, is flattened on both sides along two parallel secants. The flattened parts 136 are placed, staggered at an angle of 90° to the two wedges 110, in planes parallel to the longitudinal median plane of the elbow 132.

The bending movement of the closure cap 88 in this plane is facilitated by the flattened parts 136. Furthermore, no excessive force is necessary to push on the cap 88.

What is claimed is:

1. A spray bottle for a cleaning liquid, particularly for claning toilet bowls, comprising:

(a) a manually compressible bottle body;

(b) an elbow releasably attached to an open end of said body, said elbow having a nipple;

(c) an impact closure means for attaching said elbow to said body comprising two rows, staggered in the plug-in direction, of studs respectively arranged at inervals on said elbow which catch on two correspondingly staggered webs of said bottle body;

(d) a spray nozzle located in the upper terminal region of said body which comprises a nozzle mouthpiece and a closure cap, said nozzle being releasably attached to the elbow nipple; and (e) a means for attaching said nozzle to the elbow nipple, such that a center axis of said nozzle which points in the spraying direction encloses an angle between about 50° and 75° relative to the longitudinal direction of said bottle body.

2. A spray bottle as claimed in claim 1, wherein said angle is approximately 73°.

3. A spray bottle as claimed in claim 1, wherein said elbow is connected to said bottle body by means for providing doubly secure fluid-tightness.

4. A spray bottle as claimed in claim 3, wherein said providing means comprises, a pipe section provided in said elbow which comes into sealed plug-in connection with a neck of said bottle body.

5. A spray bottle as claimed in claim 1, further comprising a means for guiding the elbow when placed on the bottle body such that the elbow is aligned with the spray bottle.

6. A spray bottle as claimed in claim 5, wherein said guiding means comprises a guide device comprising a bar molded integrally on the elbow which engages positively into a groove of the bottle body.

7. A spray bottle as claimed in claim 1, wherein the nozzle mouthpiece has an outward-flared trumpet-shaped tip configuration.

8. A spray bottle for a cleaning liquid, particularly for cleaning toilet bowls, comprising:

(a) a manually compressible bottle body;

(b) an elbow releasably attached to an open end of said body, said elbow having an end face inclined obliquely to the longitudinal axis of the bottle body in the fitted state and a nipple projecting in a perpendicular direction from said end face;

(c) an impact closure means for attaching said elbow to said body;

(d) a spray nozzle located in the upper terminal region of said body which comprises a nozzle mouthpiece and a closure cap, said nozzle being releasably attached to the elbow nipple; and (e) a means for attaching said nozzle to the elbow nipple such that a center axis of said nozzle which points in the spraying direction encloses an angle between about 50° and 75° relative to the longitudinal direction of said bottle body wherein an end plate which exhibits a plurality of orifices, particularly two eccentrically arranged orifices, is provided at the base of the nipple, at the height of the elbow end face.

9. A spray bottle for a cleaning liquid, particularly for cleaning toilet bowls, comprising:

(a) a manually compressible bottle body;

(b) an elbow releasably attached to an open end of said body, said elbow having a nipple with a substantially annular catch web flattened on a part of the web circumference;

(c) an impact closure means for attaching said elbow to said body;

(d) a spray nozzle located in the upper terminal region of said body which comprises a nozzle mouthpiece and a closure cap, said nozzle being releasably attached to the elbow nipple;

(e) a means for attaching said nozzle to the elbow nipple such that a center axis of said nozzle which points in the spraying direction encloses an angle between about 50° and 75° relative to the longitudinal direction of said bottle body; and (f) a childproof closure cap comprising a pipe section having an all-round rib which engages behind the catch web on the nipple, said flattened portions of said catch web facilitating snapping and releasing of the closure cap.

10. A spary bottle as claimed in claim 9, wherein said flattened part of the web circumference is along two parallel secants opposite each other on the web circumference, in order to facilitate easy bending of the closure cap over the catch web.

11. A spray bottle as claimed in claim 10, further comprising an elbow end face having two wedges, wherein the flattened parts of the web circumference are placed staggered at an angle of 90° relative to the two wedges so that the closure cap can be bent over the catch web.

12. A spray bottle as claimed in claim 11, further comprising two projections on opposite sides of the inside of the closure cap which contact the wedges on the elbow end face when the closure cap is compressed.

13. A spray bottle as claimed in claim 12, wherein the wedges comprise oblique ramp surfaces.

* * * * *